US008951091B2

(12) United States Patent
Payne

(10) Patent No.: US 8,951,091 B2
(45) Date of Patent: Feb. 10, 2015

(54) TOY VEHICLE PLAYSET AND COLOR CHANGING TOY VEHICLE

(75) Inventor: Julian Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 344 days.

(21) Appl. No.: 13/435,638

(22) Filed: Mar. 30, 2012

(65) Prior Publication Data

US 2013/0078887 A1 Mar. 28, 2013

Related U.S. Application Data

(60) Provisional application No. 61/472,354, filed on Apr. 6, 2011.

(51) Int. Cl.

| | |
|---|---|
| ***A63H 29/00*** | (2006.01) |
| ***A63H 18/00*** | (2006.01) |
| ***A63H 17/26*** | (2006.01) |
| ***A63H 18/14*** | (2006.01) |
| ***A63H 18/16*** | (2006.01) |
| ***A63H 33/22*** | (2006.01) |
| ***A63H 17/00*** | (2006.01) |

(52) U.S. Cl.

CPC ..... *A63H 17/26* (2013.01); *A63H 18/14* (2013.01); *A63H 18/16* (2013.01); *A63H 33/22* (2013.01); *A63H 17/008* (2013.01)

USPC ..... 446/429; 446/444

(58) Field of Classification Search

USPC ..... 446/14, 444, 470, 429, 485

See application file for complete search history.

(56) References Cited

U.S. PATENT DOCUMENTS

| | | | |
|---|---|---|---|
| 1,807,415 | A | 5/1931 | La France |
| 2,297,033 | A | 9/1942 | Stahr et al. |
| 2,730,993 | A | 1/1956 | Boyle |
| 2,882,246 | A | 4/1959 | Leatherman et al. |
| 2,921,407 | A | 1/1960 | Wagner et al. |
| 3,074,975 | A | 1/1963 | McCormick et al. |
| 3,134,674 | A | 5/1964 | Brown, Jr. |
| 3,166,050 | A | 1/1965 | Fehling et al. |
| 3,443,332 | A | 5/1969 | Christy |
| 3,652,285 | A | 3/1972 | Delzenne et al. |
| 3,694,953 | A | 10/1972 | Tomiyama |
| 3,696,098 | A | 10/1972 | Hoefnagels et al. |
| 3,813,554 | A | 5/1974 | Chang et al. |
| 3,933,708 | A | 1/1976 | Brinkman |
| 3,980,300 | A | 9/1976 | Hornsby, Jr. |
| 4,026,869 | A | 5/1977 | Evens et al. |
| 4,036,805 | A | 7/1977 | Tsujimoto et al. |
| 4,134,853 | A | 1/1979 | Ehrlich et al. |
| 4,176,273 | A | 11/1979 | Fujie et al. |
| 4,208,701 | A | 6/1980 | Schock |

(Continued)

FOREIGN PATENT DOCUMENTS

| | | | |
|---|---|---|---|
| JP | 7314984 | A | 12/1995 |
| JP | 2007089823 | A | 4/2007 |

(Continued)

*Primary Examiner* — Gene Kim
*Assistant Examiner* — Alyssa Hylinski
(74) *Attorney, Agent, or Firm* — Edell, Shapiro & Finnan, LLC

(57) ABSTRACT

A toy vehicle playset has a color changing device or mechanism that can be used to activate a color change on a toy vehicle. In one embodiment, the playset includes a chamber configured to receive the toy vehicle. In another embodiment, the playset includes a launching mechanism that propels the toy vehicle along a track member and into a chamber.

19 Claims, 15 Drawing Sheets

(56) References Cited

U.S. PATENT DOCUMENTS

| | | | | | |
|---|---|---|---|---|---|
| 4,212,786 | A | | 7/1980 | Murakami | |
| 4,257,188 | A | | 3/1981 | Barker | |
| 4,349,983 | A | | 9/1982 | Kilroy et al. | |
| 4,356,657 | A | * | 11/1982 | Goldfarb et al. | 446/236 |
| 4,427,387 | A | | 1/1984 | Tomita | |
| 4,525,214 | A | | 6/1985 | Panken | |
| 4,590,381 | A | | 5/1986 | Mendelson | |
| 4,599,614 | A | | 7/1986 | DeBerry et al. | |
| 4,678,450 | A | | 7/1987 | Scolari et al. | |
| 4,734,076 | A | | 3/1988 | Goldstein et al. | |
| 4,779,166 | A | | 10/1988 | Tanaka et al. | |
| 4,826,550 | A | | 5/1989 | Shimizu et al. | |
| 4,844,990 | A | | 7/1989 | White | |
| 4,917,643 | A | | 4/1990 | Hippely et al. | |
| 4,961,716 | A | | 10/1990 | Hippely et al. | |
| 5,001,243 | A | | 3/1991 | Fischer et al. | |
| 5,052,972 | A | * | 10/1991 | Suimon et al. | 446/429 |
| 5,091,006 | A | | 2/1992 | Sarada et al. | |
| 5,177,227 | A | | 1/1993 | Fischer et al. | |
| 5,186,867 | A | | 2/1993 | Castaldi et al. | |
| 5,190,298 | A | | 3/1993 | Lee et al. | |
| 5,203,702 | A | | 4/1993 | Wilson | |
| 5,208,132 | A | | 5/1993 | Kamada et al. | |
| 5,208,354 | A | | 5/1993 | Fischer et al. | |
| 5,294,522 | A | | 3/1994 | Uchida et al. | |
| 5,311,413 | A | | 5/1994 | Farmer et al. | |
| 5,407,885 | A | | 4/1995 | Fischer et al. | |
| 5,441,418 | A | | 8/1995 | Brown et al. | |
| 5,474,603 | A | | 12/1995 | Miyashita et al. | |
| 5,480,338 | A | | 1/1996 | Barthold | |
| 5,498,280 | A | | 3/1996 | Fistner et al. | |
| 5,503,583 | A | | 4/1996 | Hippely et al. | |
| 5,586,923 | A | * | 12/1996 | Hippely et al. | 446/14 |
| 5,643,040 | A | * | 7/1997 | Hippely et al. | 446/429 |
| 5,914,197 | A | | 6/1999 | Goudjil | |
| 5,936,878 | A | | 8/1999 | Arsenov et al. | |
| 5,938,065 | A | | 8/1999 | De Vivo et al. | |
| 5,945,252 | A | | 8/1999 | Sokoluk et al. | |
| 6,036,334 | A | | 3/2000 | Nakano | |
| 6,074,465 | A | | 6/2000 | Fukuo et al. | |
| 6,099,629 | A | | 8/2000 | Morita et al. | |
| 6,145,512 | A | | 11/2000 | Daley | |
| 6,322,416 | B1 | * | 11/2001 | Burke | 446/175 |
| 6,499,840 | B2 | | 12/2002 | Day et al. | |
| 6,585,555 | B2 | | 7/2003 | Wong et al. | |
| 6,595,826 | B2 | | 7/2003 | Koizumi | |
| 6,666,742 | B2 | | 12/2003 | Koizumi | |
| 6,860,616 | B2 | | 3/2005 | Yu et al. | |
| 6,902,334 | B1 | | 6/2005 | Kung | |
| 6,916,537 | B2 | | 7/2005 | Welch et al. | |
| 7,044,614 | B2 | | 5/2006 | Levy et al. | |
| 7,249,431 | B1 | | 7/2007 | Rose et al. | |
| 7,547,109 | B2 | | 6/2009 | Schmidt et al. | |
| 8,684,784 | B2 | * | 4/2014 | Schmidt et al. | 446/219 |
| 8,708,767 | B2 | * | 4/2014 | Heller et al. | 446/147 |
| 2003/0127797 | A1 | | 7/2003 | Katz et al. | |
| 2003/0137258 | A1 | | 7/2003 | Piepgras et al. | |
| 2004/0076460 | A1 | | 4/2004 | Yu et al. | |
| 2004/0135097 | A1 | | 7/2004 | Shibahashi et al. | |
| 2004/0266554 | A1 | | 12/2004 | Park et al. | |
| 2006/0226235 | A1 | | 10/2006 | Shepherd et al. | |
| 2007/0048065 | A1 | | 3/2007 | Schmidt et al. | |
| 2007/0054590 | A1 | | 3/2007 | Schmidt et al. | |
| 2007/0054594 | A1 | * | 3/2007 | Schmidt et al. | 446/424 |
| 2007/0060013 | A1 | | 3/2007 | Schmidt et al. | |
| 2007/0128972 | A1 | | 6/2007 | Schmidt et al. | |
| 2007/0273951 | A1 | | 11/2007 | Ribi | |

FOREIGN PATENT DOCUMENTS

| | | | | |
|---|---|---|---|---|
| JP | 2009172021 | A | * | 8/2009 |
| WO | 2007020418 | A1 | | 2/2007 |

* cited by examiner

TOY VEHICLE PLAYSET AND COLOR CHANGING TOY VEHICLE

CROSS-REFERENCE TO RELATED APPLICATION

This application claims priority to and the benefit of U.S. Provisional Patent Application No. 61/472,354, filed Apr. 6, 2011, entitled "Toy Vehicle Playset and Color Changing Toy Vehicle," the entire disclosure of which is incorporated by reference herein in its entirety.

BACKGROUND OF THE INVENTION

Toys that have a portion that changes color are known. For example, some conventional toys include thermochromic material that changes color as the temperature of the toy, and in particular, the portion with the thermochromic material, changes. However, many conventional color changing toys lack a playset for use therewith in changing the color of the toy.

Thus, there is a need for a playset that can be used with color changing toy vehicles. In addition, there is a need for a toy vehicle playset with one or more color changing mechanisms that can be used to change the color of a toy vehicle.

SUMMARY OF THE INVENTION

In one embodiment, a toy vehicle playset includes a chamber that is configured to receive a toy vehicle with color changing properties. The playset includes a light source, such as a flash tube, proximate to the chamber. The light source can be activated to illuminate the chamber and apply light to a toy vehicle located in the chamber. The color changing material on the toy vehicle can change from clear to opaque in response to the light from the light source.

In one embodiment, the playset includes a launcher or launching mechanism that can be used to propel or eject the toy vehicle from the chamber. The launcher can be actuated by a child. The launcher can be coupled to the light source so that the actuation of the launcher results in the illumination of the light source and then the launching of the changed toy vehicle. In an alternative embodiment, the playset includes a switch that can be used to illuminate the light source without resulting in the launching of the toy vehicle. In still another embodiment, the playset may permit the vehicle to leave the chamber without the use of a launcher or launching mechanism—for example, by gravity alone.

In addition, the playset can include a tubular member through which the toy vehicle can travel. The tubular member can include light sources therein that direct light onto the passing toy vehicle.

The playset also includes a decorating area where the launched toy vehicle stops after its travel. The decorating area includes a rotatably mounted platform on which the toy vehicle can be positioned. The platform is rotatably by a child using an actuator that is coupled to the platform. The playset includes a light instrument that can be used by a child to direct ultraviolet (UV) light or near UV light from a light source, such as an LED, onto the toy vehicle while it is in the decorating area.

In one embodiment, the platform is adjustable so that the platform can be tipped or inclined by the child to discharge the toy vehicle from the playset when the child is finished decorating the toy vehicle.

In another embodiment, the playset can include a launcher mechanism that can launch or propel a toy vehicle along a portion of track into a color changing device. The color changing device includes a housing that is defined in part by a transparent cover that permits a child to see into the chamber or receptacle formed by the housing. The color changing device includes one or more UV LEDs that generate light that is directed toward the toy vehicle in the chamber.

In one embodiment, the UV LEDs are mounted to an arm or support that is movably supported by the housing and that can be manipulated by a child to focus the light on different parts of the toy vehicle. In another embodiment, the UV LEDs are fixedly coupled to supports that hold the LEDs in place relative to the toy vehicle in the chamber.

The color changing device includes a stop that is engaged by a toy vehicle launched into the chamber. The engagement of the toy vehicle with the stop closes a switch which results in the illumination of the UV LEDs. After the illumination process is completed, the child can rotate a handle coupled to the housing which moves the stop so that the toy vehicle can travel out of the color changing device.

The playset includes a rotatable platform onto which the toy vehicle travels from the color changing device. This platform is also rotatable by a child using an actuator. The child can use a light instrument and one of several stencils to add additional decorations to the toy vehicle.

In one embodiment, a light instrument has a nozzle that directs light output through an opening. The pattern of light output can be adjusted or changed by mounting a cap with an opening in a particular pattern or logo to the nozzle. A child can place the cap in contact with a surface of a toy vehicle to apply the violet light with a UV component from the light instrument through the patterned opening on the toy vehicle.

In one embodiment, a holder that rotatably supports a stencil can be used. The particular stencil coupled to the holder can be changed depending on the desired stencil. In addition, a transport holder can be provided to which the stencils that are not in use can be coupled for storage and transport. The transport holder also includes several openings into which the caps can be stored.

BRIEF DESCRIPTION OF THE DRAWINGS

Like reference numerals have been used to identify like elements throughout this disclosure.

DETAILED DESCRIPTION OF THE INVENTION

Figure 1:
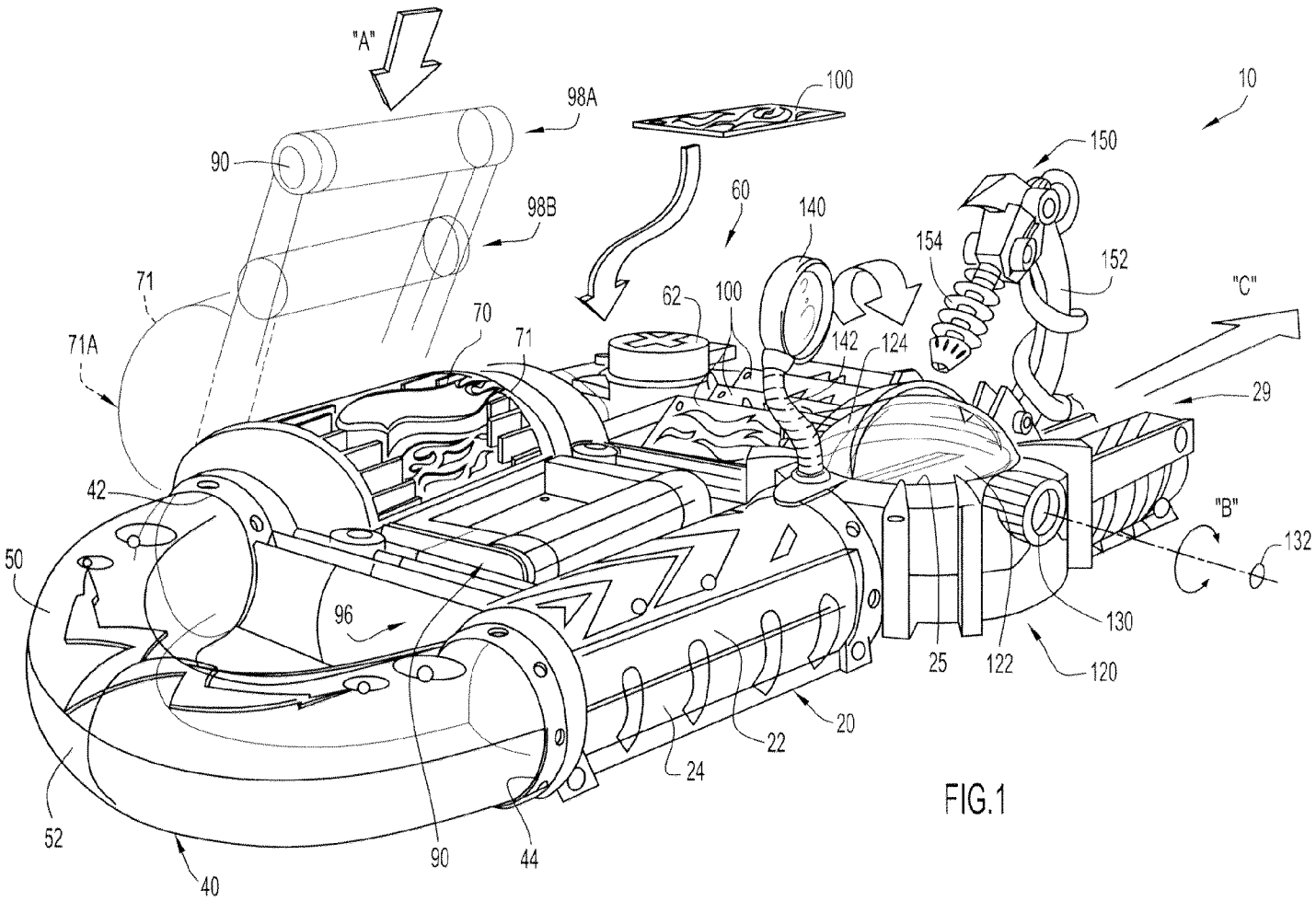
FIG. 1 illustrates a perspective view of a toy vehicle playset according to the present invention.

In one embodiment of the present invention, a toy vehicle playset includes features that facilitate the changing of the color of a toy vehicle. The playset is configured so that a child can manipulate a toy vehicle relative thereto. In addition, the playset is configured for use with a toy vehicle.

In one embodiment, the toy vehicle includes a violet light activated paint thereon. The paint includes a color change pigment that changes in response to the presence or application of UV or near UV light. The toy vehicle may include a body portion that is formed of a molded plastic or resin. The color change pigment can be located in the molded plastic either throughout the body of the toy vehicle or one or more portions of the body of the toy vehicle. The color change pigment can be localized or concentrated in certain areas to form a pattern on the toy vehicle. Alternatively, the paint can be applied to an outer surface of the body of the toy vehicle. When violet light is applied to the toy vehicle, the UV component of the light activates the paint and changes the color from clear to tinted.

The term "toy vehicle" is used herein generally to refer to any type of toy vehicle. While a toy vehicle in the shape of a car is illustrated in the drawings, the toy vehicle can be a truck, or other vehicle. The toy vehicle can be a diecast car as well.

Figure 2:
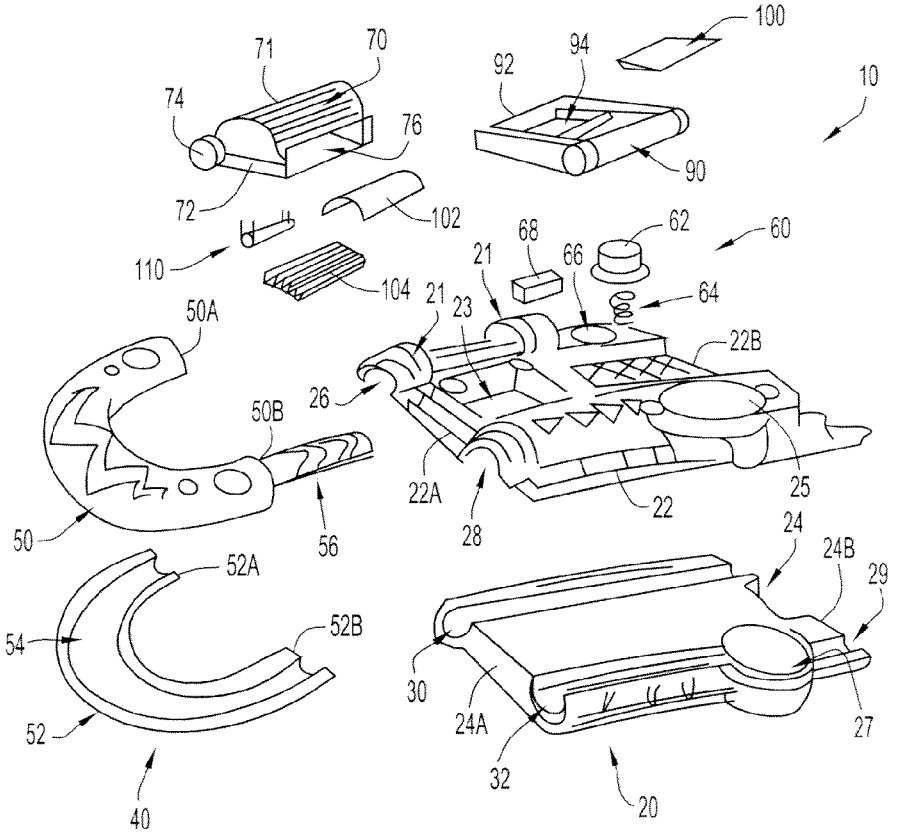
FIG. 2 illustrates an exploded perspective view of the components of the toy vehicle playset illustrated in FIG. 1.

Referring to FIGS. 1 and 2, assembled and exploded perspective views of a toy vehicle playset are illustrated, respectively. In this embodiment, the toy vehicle playset 10 includes a housing 20 that is formed of an upper housing portion 22 and a lower housing portion 24, as shown in FIG. 2. The housing portions 22 and 24 are formed of molded plastic and coupled together via connectors, such as screws. Alternatively, the housing portions 22 and 24 can be friction fit or snapped together. As shown in FIG. 2, housing portion 22 has opposite ends 22A and 22B and housing portion 24 has opposite ends 24A and 24B.

Housing portion 22 includes a pair of channels or grooves 26 and 28 formed therein. Similarly, housing portion 24 includes a pair of channels or grooves 30 and 32 therein. When the housing portions 22 and 24 are coupled together, grooves 26 and 30 cooperate to form a tubular-shaped channel and grooves 28 and 32 cooperate to form a tubular-shaped channel. Each of the channels is configured so that a toy vehicle can travel therethrough. Grooves 26 and 30 extend between the ends 22A, 24A and 22B, 24B. Grooves 28 and 32 do not extend the full length of the housing portions 22 and 24. As shown in FIG. 2, groove 32 ends at an opening or chamber 27 where the toy vehicle is stopped. As described in detail below, the toy vehicle stops on a platform that is manipulatable by a child to use during additional decorating of the toy vehicle. Lower housing portion 24 includes a discharge or exit area 29 through which the toy vehicle can exit the housing 20 and the playset 10.

Figure 3:
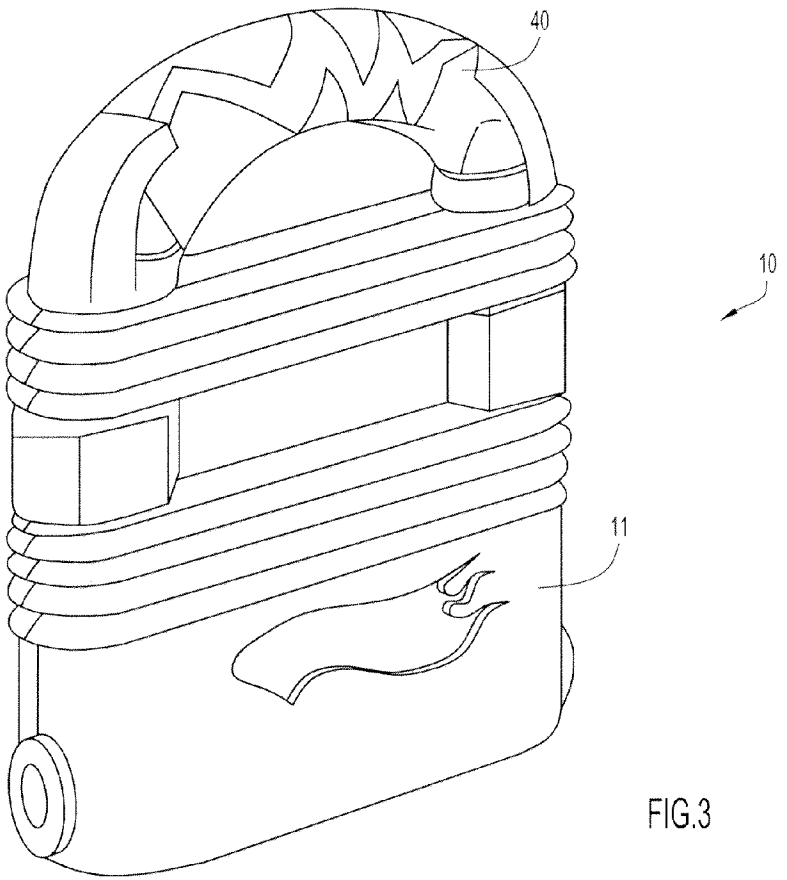
FIG. 3 illustrates a perspective view of the toy vehicle playset illustrated in FIG. 1 in a collapsed configuration.

Referring back to FIG. 1, the playset 10 includes a curved member 40 that can be used as a handle by a child to carry the playset 10 (such as shown in FIG. 3) when the housing is in a collapsed configuration 11. The curved member 40 is formed of an upper curved portion 50 and a lower curved portion 52. In one embodiment, the curved portions 50 and 52 are transparent or translucent, thereby permitting a child to see into the curved member 40. In one embodiment, either one or both of the curved portions 50 and 52 may be tinted. The curved member 40 has opposite ends 42 and 44 (see FIG. 1) that can be coupled to the housing 20. In one embodiment, the ends 42 and 44 can be inserted into openings formed in the housing 20 by the grooves in the upper and lower housing portions 22 and 24. In that arrangement, the ends 42 and 44 can be retained in the grooves via friction. In another embodiment, the ends 42 and 44 can be secured to the housing 20 by connectors, such as screws.

Each of the curved portions 50 and 52 includes a groove along its inner surface. Referring to FIG. 2, the grooves extend from end 50A to end 50B in curved portion 50 and from end 52A to end 52B in curved portion 52. In FIG. 2, only groove 54 in curved portion 52 is shown for simplicity only. When the upper and lower curved portions 50 and 52 are coupled together, the grooves in each of the curved portions collectively form a tubular channel through which a toy vehicle can travel. This tubular channel is in communication with the previously described channels formed by the housing portions 22 and 24. As a result, a toy vehicle can travel from the channel formed by grooves 26 and 30, into and through the channel formed in curved portion 40, and through the channel formed by grooves 28 and 32 to the decorating area near chamber 27.

In this embodiment, upper curved portion 52 includes a projection 56 that extends from end 50B. The projection 56 is inserted into the groove 28 when the curved member 40 is mounted to the housing 20.

Referring back to FIG. 1, the toy playset 10 includes several locations at which light, such as violet light with a UV component, can be applied to a toy vehicle in or on the playset 10. The toy vehicle includes a light-activated pigment or paint on or in at least a portion of the toy vehicle. For example, the pigment or paint can be included in the material that is molded to form the body of the toy vehicle. Alternatively, the pigment or paint can be applied to an outer surface of the body of the toy vehicle as a coating of paint, a sticker, or other additional material. Also, the pigment or paint can be included on any portion of the toy vehicle, including the body and/or the wheels.

The playset 10 includes a light chamber 70 that contains a light source that can be activated to illuminate the toy vehicle in the light chamber 70. In addition, a light source can be located in the curved member 40 so that a toy vehicle passing through curved member 40 is illuminated as well. Finally, the playset 10 includes a design portion or area 120 that can be used by a child to decorate or further modify the appearance of the toy vehicle. In this embodiment, a light instrument 150 is located near the area 120 and can be used by a child to apply additional light to the toy vehicle.

Figure 4:
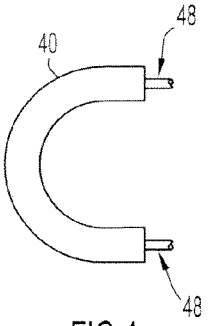
FIG. 4 illustrates a top view of a handle portion of the toy vehicle playset illustrated in FIG. 1.

In this embodiment, as shown in FIG. 4, the curved member 40 includes light piping 48 that extends along the interior of the curved member 40. The light piping 48 can be used to provide illumination to the toy vehicle passing through the channel of the curved member 40 to activate the color changing pigment on the toy vehicle 200. Several LEDs (not shown) are located along the light piping 48 in curved member 40 to provide light in the tunnel of the curved member 40.

Referring back to FIGS. 1 and 2, a lid 71 is movably coupled to the housing 20. As shown in FIG. 2, the upper housing portion 22 has a pair of shoulders 21 and a cavity 23 formed therein. The lid 71 has a body 72 and a mounting end 74. The mounting end 74 is sized so that it fits between the shoulders 21 on housing portion 22. The shoulders 21 have openings that receive projections on opposite sides of the mounting end 74 to rotatably mount the lid 71 to housing portion 22. The lid 71 also includes a cavity or receptacle 76 formed therein.

A handle or loader 90 is slidable into the cavity 76 in the lid 71. The loader 90 has with an end 92 and a receptacle 94 formed therein. The receptacle 94 is sized to receive a stencil 100 that includes one or more transparent or open portions surrounded by opaque material. The stencil 100 can be placed in the receptacle 94 and the loader 90 slid into the cavity 76 in the lid 71. Referring to FIG. 1, the movement of the loader 90 with the lid 71 is illustrated. After a stencil 100 is placed in the loader 90, the lid 71 is pivoted to an opened position 71A (shown in phantom). The loader 90 is aligned with the cavity 76 and moved along the direction of arrow "A" from a first position 98A to a second position 98B in which the stencil 100 is located within the lid 71. After the loader 90 has been inserted, the lid 71 and the loader 90 can be pivoted toward the upper housing portion 22 to a use position 96.

Also as shown in FIG. 1, the upper housing portion 22 has several slits or slots into which different stencils 100 can be inserted and stored when not in use.

Figure 5:
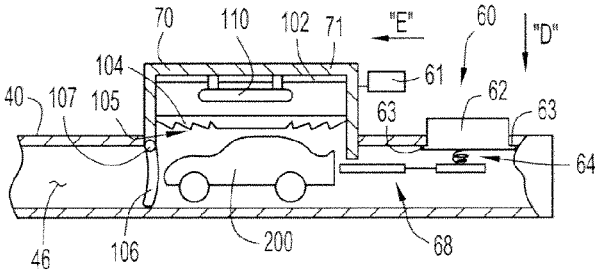
FIG. 5 illustrates a cross-sectional view of a launching portion and an illuminating portion of the toy vehicle playset illustrated in FIG. 1.

Referring to FIGS. 2 and 5, some of the components of the light chamber 70 are described. In light chamber 70 there is a Mylar® (a DuPont trade name for biaxially-oriented polyethylene terephthalate, or BoPET, polyester film) sheet 102 that is located along the inner surface of the lid 71. In addition, a light source 110 is positioned inside of the Mylar sheet 102. A lens 104 is positioned beneath the light source 110. In one embodiment, the lens 104 is a Fresnal lens with a face 105 having several facets formed thereon that are angled to direct light from the light source 110 toward a toy vehicle 200 located beneath the lid 71 in the light chamber 70. In an alternative embodiment, the lens 104 may have a substantially planar face without facets.

In this embodiment, the light source 110 is a Xenon flash tube. When activated, the flash tube briefly illuminates the interior of the light chamber 70. The lens 104 can focus the flash of light from the tube 110 toward the toy vehicle 200. In one embodiment, the housing 20 includes a switch that prevents the light source 110 from illuminating if the lid 71 is in an opened position and not closed.

Referring to FIG. 5, another Mylar sheet 106 is coupled proximate to the lid 71. The Mylar sheet 106 is used to contain the light from the light source 110 in the light chamber 70. The Mylar sheet 106 can be flexible so that the toy vehicle 200 can contact and move along the sheet 106 into the channel 46 in curved member 40. Alternatively or in addition, the sheet 106 can be pivotally mounted at joint 107 so that the sheet 106 pivots about joint 107 when the sheet 106 is engaged by the toy vehicle 200.

Figure 5A:
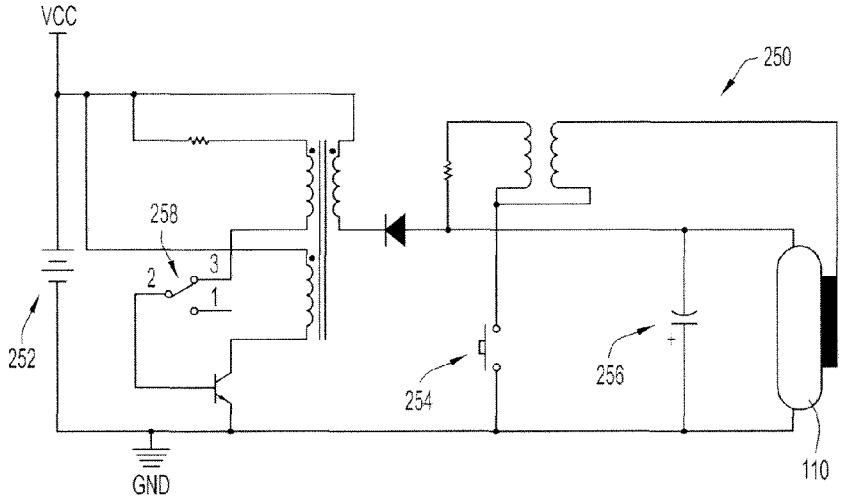
FIG. 5A illustrates a schematic of the electronic circuit for the toy vehicle playset illustrated in FIG. 1.

Referring to FIG. 5A, a diagram of the circuit for the light chamber 70 is illustrated. In this embodiment, the circuit 250 includes a power source 252, such as a "AA" battery, and the light source 110, which is a Xenon flash tube. The circuit 250 also includes a push button switch 254, a capacitor 256, and another switch 258.

Referring back to FIGS. 1, 2, and 4, the playset 10 includes an actuator mechanism 60 that can be used to propel or launch a toy vehicle 200 within the playset 10. In this embodiment, the actuator mechanism 60 includes a button 62 that is mounted for movement in an opening 66 (see FIG. 2) formed in the housing 20. The button 62 is biased upwardly by a biasing member 64, such as a spring. The movement of the button 62 upwardly is limited by the engagement of a shoulder 63 formed around the perimeter of the button 62 with an inner surface defining the opening 66. The button 62 is connected to a launcher 68 that is configured to engage the toy vehicle 200. Referring to FIG. 5, when a child presses on button 62 along the direction of arrow "D," the launcher 68 causes the toy vehicle 200 to move out of the light chamber 70 and into channel 46 along the direction of arrow "E."

In addition, pressing the button 62 results in a flash of light from light source 110. Thus, the toy vehicle 200 is launched out of the chamber 70 the instant that it is blasted with light. Alternatively and/or in addition, a separate switch 61 is provided that can activate the light source 110 without launching the toy vehicle 200.

The moving toy vehicle 200 then travels through the curved member 40 and back into the housing 20. As the toy vehicle 200 moves through curved member 40, the light piping 48 can be illuminated constantly and/or intermittently (flashing) for a few seconds. The light from the light piping 48 illuminates the toy vehicle 200 as well as facilitates the viewing of the internal channel 46 of the curved member 40.

Thus, once the flash tube 110 is illuminated, the color change pigment of the toy vehicle 200 is activated. This activation results in the color of one or more portions of the toy vehicle 200 changing from the initial appearance of the toy vehicle 200. The toy vehicle 200 travels until it reaches the decorating area 120 of the playset 10.

Figure 6:
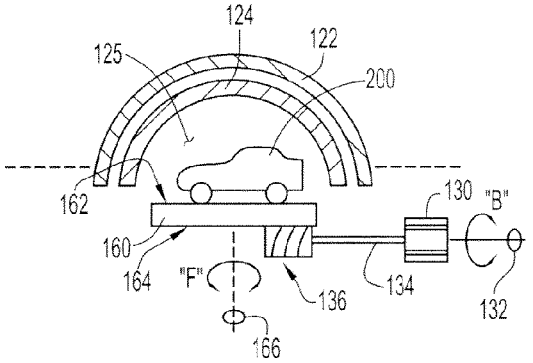
FIG. 6 illustrates a partial cross-sectional view of some components of the toy vehicle playset illustrated in FIG. 1.

Referring to FIGS. 1, 2, and 6, the housing 20 has an opening 25 that permits a child to view the toy vehicle 200 when the toy vehicle 200 is stopped in the chamber 125 (see FIG. 6) of area 120. In this embodiment, a pair of plastic dome-like structures 122 and 124 is pivotally mounted to the housing 20. The dome-like structures 122 and 124 are transparent and tinted to permit light to pass therethrough and to allow the child to view the toy vehicle 200. In one implementation, the dome-like structures 122 and 124 can be pivoted away from each other to allow a child to access the chamber and remove the toy vehicle 200 manually, if desired. Each of the structures 122 and 124 can be raised individually for different tinted effects.

The decorating area 120 includes a light instrument 150 that can be used by a child to decorate the toy vehicle 200, a portion of which has already changed color. The light instrument 150 is mounted on a flexible support 152 that allows for the repositioning of the light instrument 150 and in particular, the light emitting portion 154. The lower end of the flexible support 152 is insertable into an opening in the playset to mount the light instrument 150. The flexible support 152 retains its position until moved again by the child. The light emitting portion 154 includes a light source that emits UV light or violet light with a UV component. The emitted light can be directed onto the surface of the toy vehicle 200 to create a pattern or visual effect on the toy vehicle 200. The light instrument 150 is removable and has its own power source.

The decorating area 120 includes a magnifying glass 140 that is coupled to a flexible support 142 that permits movement of the glass 140 by a child. Once moved, the flexible support 142 retains its position until moved again by the child. Accordingly, a child can position the glass 140 as desired for use in inspecting and decorating the toy vehicle 200.

When the toy vehicle 200 is in the decorating area 120, the toy vehicle 200 is on a platform 160 as shown in FIG. 6. The platform 160 has an upper surface 162 and a lower surface 164. In this embodiment, the platform 160 is mounted for rotation back and forth along the directions of arrow "F" about an axis 166. As shown in FIGS. 1 and 6, a knob 130 is accessible for a child to grasp and rotate along the directions of arrow "B" about an axis 132. As the platform 160 rotates, a child can decorate the toy vehicle 200 thereon with a light pen, such as by drawing a continuous stripe around the toy vehicle 200.

In this embodiment, the knob 130 is coupled to an end of an elongate member or rod 134 that has a longitudinal axis that forms axis 132. The other end of the elongate member 134 is engaged with the platform 160 and can cause the platform 160 to move. For example, a driver member 136 with an outer surface is in contact with the platform so that as the knob 130 rotates, the elongate member 134 and the driver member 136 also rotate, thereby causing the platform 160 to rotate about axis 166. The rotation of the platform 160 and the toy vehicle 200 thereon allows a child to decorate different portions of the toy vehicle 200 with light instrument 150 while in the chamber 125.

Figure 7:
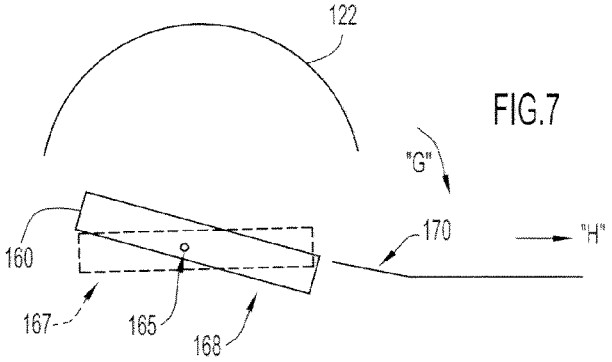
FIG. 7 illustrates a schematic view of some components of the toy vehicle playset illustrated in FIG. 1.

When the child has finished decorating the toy vehicle 200 in chamber 125, the toy vehicle 200 can be released from the chamber 125 and allowed to move out of the housing 20 along the direction of arrow "C" in FIG. 1 via exit or ramp 29. Referring to FIG. 7, a schematic diagram is illustrated showing this movement of the toy vehicle 200. The platform 160 can tip or tilt relative to the dome-like structure 122. In this embodiment, the platform 160 can pivot about axis 165 along the direction of arrow "G" from a decorating position 167 (shown in phantom) in which the platform 160 is substantially horizontal to a releasing position 168 in which the platform 160 is proximate to an exit track 170. When the platform 160 is in its releasing position 168, a toy vehicle 200 thereon can roll from the platform 160 to the track 170 and exit the housing along the direction of arrow "H." The pivoting of the platform 160 can be accomplished using a lever or actuator that is coupled to the housing 20 and the platform 160.

Figure 8:
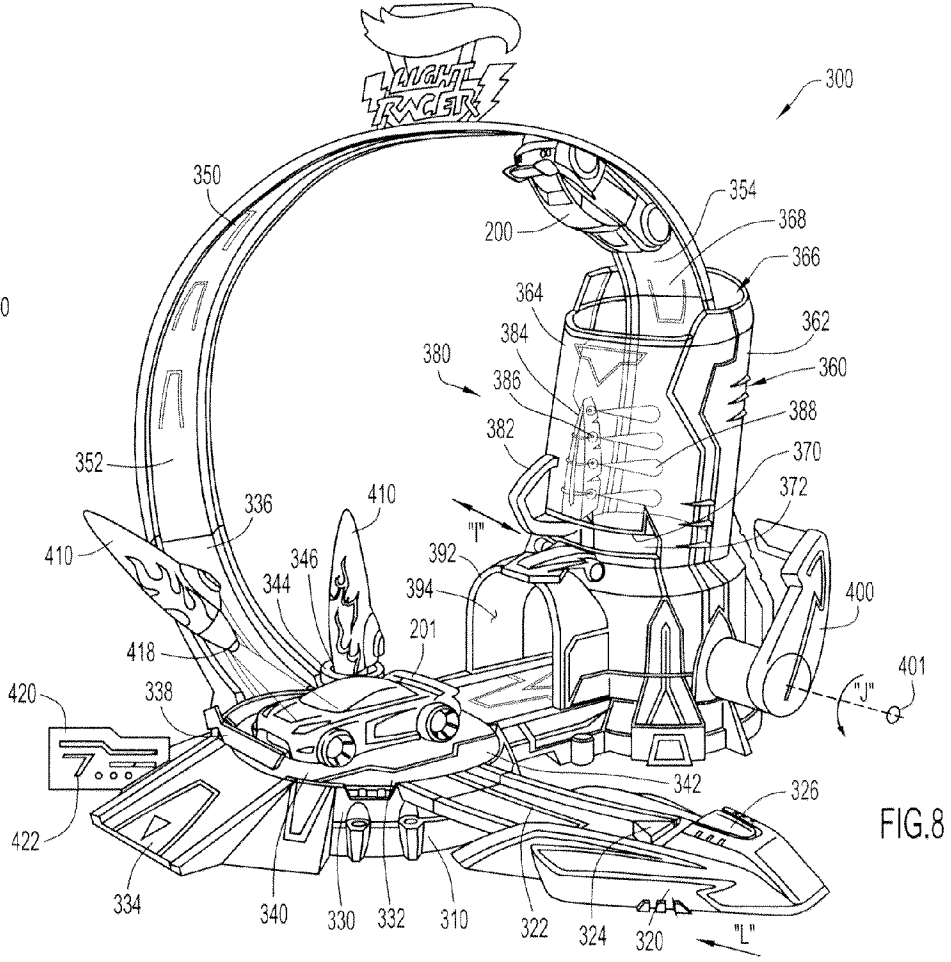
FIG. 8 illustrates a perspective view of another embodiment of a toy vehicle playset according to the present invention.

Referring to FIG. 8, an alternative embodiment of a playset according to the present invention is illustrated. In this embodiment, a toy vehicle is initially placed on a launcher. The toy vehicle is launched along a portion of track into a light chamber. The toy vehicle, which has color changing properties, is immersed in UV light from one or more light sources. After the color changing portion of the toy vehicle has changed color, the child can release the car from the light chamber. The changed toy vehicle stops on a rotatable platform and can be further decorated by a child using a light instrument.

As shown in FIG. 8, the playset 300 includes a base 310, a launcher 320, an intersecting portion 330, a track portion in the form of a loop 350, and a light chamber or color changing device 360. The base 310 is configured to be placed on a support surface. The launcher 320 is coupled to the base 310 and has a track portion 322 and an engagement member 324 that is cocked or loaded relative to the body of the launcher 320. When the engagement member 324 is loaded, a child can press on the actuator 326 to release the spring-loaded member 324, which engages the toy vehicle 200 and propels it along the direction of arrow "L" through the intersecting portion 330 and along the track loop portion 350. The intersecting portion 330 includes a track portion 336 with which an end 352 of the loop 350 is coupled via friction or a connector. The other end 354 of the loop 350 is coupled to a track portion 368 of the color changing device 360 via friction or a connector.

The color changing device 360 is formed of housing portions 362 and 364 that are coupled together. In this embodiment, housing portion 364 is transparent and permits a user to view the interior area or chamber 366 of the device 360. Proximate to a lower end of the transparent housing portion 364 is an edge 370 to forms a slot 372.

Figure 8A:
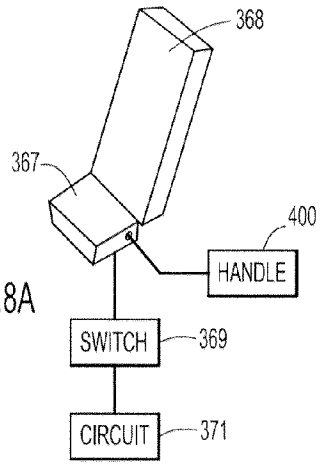
FIG. 8A illustrates a schematic view of part of the playset illustrated in FIG. 8.

As shown in FIG. 8A, the track portion 368 in the chamber 366 has a stop 367 that limits the movement of the toy vehicle 200 in the chamber 366. The stop 367 can function as a releasable trap door. The stop 367 is located proximate to the lower end of the track portion 368. The toy vehicle 200 travels into the chamber until the toy vehicle 200 engages the stop 367. Coupled to the stop 367 or proximate thereto is a switch 369 that is closed when the toy vehicle 200 engages the stop 367 and is in its decorating position in the chamber 366. The switch 369 is part of an electronic circuit 371 and when the switch 369 is closed, the light sources in the chamber 366 are turned on and illuminated. The circuit 371 includes a power source, such as multiple "AA" batteries.

The device 360 includes a light applicator 380 that is movable relative to the housing portion 364 and the chamber 366. The light applicator 380 includes a handle 382 that extends through the slot 372 and that is coupled to a body 384. The distal end of the handle 382 is sized so that it can be grasped by a child and moved back and forth along the slot 372 along the directions of arrow "I." Coupled to the body 384 are several UV LEDs 386. The LEDs 386 generate UV light 388 which is directed toward the track portion 368. When the toy vehicle 200 closes the switch 369, the LEDs 386 are illuminated and the UV light 388 is directed at the toy vehicle 200.

In one implementation, the LEDs 386 are illuminated in a flashing sequence for two seconds, are illuminated continuously for seventeen seconds, and finally flash for one second. In different implementations, the pattern of illumination of the LEDs 386 can vary.

The housing of the color changing device 360 has an exit 392 that defines an opening 394 through which the toy vehicle 200 in the chamber 366 can pass after the stop 367 is released by movement of the handle 400 by a child along the direction of arrow "J" about axis 401. The handle 400 is coupled to stop 367, which moves relative to the track 368 to a position that permits the toy vehicle 200 to be released from the chamber 366.

The released toy vehicle 201 travels until it engages stop 338, which is pivotally mounted to intersection portion 330. Engagement with the stop 338 causes the changed toy vehicle 201 to remain on the upper surface 342 of a platform 340 that is rotatably mounted in a cavity 332 in platform 330. In one embodiment, the orientation of the platform 340 can be changed by a child via an actuator, similar to that described above relative to FIG. 6.

Figure 16:
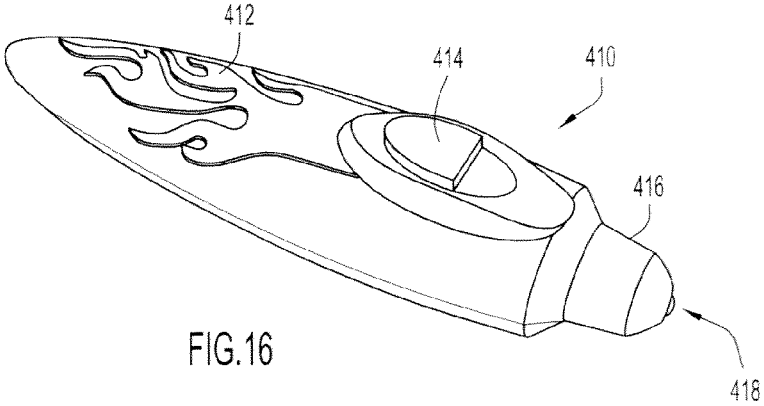
FIG. 16 illustrates an internal side view of the light applicator illustrated in FIG. 15.

In this position, a child can decorate the changed toy vehicle 201 using a light instrument 410, such as a light pen. The light instrument 410 includes a light source 418 that generates UV light that can be directed onto a surface of the toy vehicle 201. Referring to FIG. 16, an exemplary light instrument 410 is illustrated. The light instrument 410 includes a body 412 and an actuator 414 that can be pressed to close a switch and activate the illumination circuit of the instrument 410. The forward end 416 of the instrument 410 includes a light source 418 that emits or generates light. The instrument 410 has its own power source, which can be several button cells.

Referring back to FIG. 8, the light from the light instrument 410 can be shown through slots or transparent portions 422 of a stencil 420 that is held proximate to toy vehicle 201 by a child. If the stencil 420 is held in position relative to the toy vehicle 201, a specific pattern or patterns can be drawn on the toy vehicle 201 in the shape of the slot or slots through which the UV light passes from instrument 410. In one embodiment, the stencil 420 is made of a soft clear material type that can stick to a toy vehicle 200, such as a diecast car, and not slide on the toy vehicle 200.

When the instrument 410 is not in use, the instrument 410 can be inserted into an opening 346 formed in mount 344. When the child has finished decorating the toy vehicle 201, the stop 338 can be pivoted upwardly and the toy vehicle 201 can travel down ramp 334 away from the playset 300.

Figure 9:
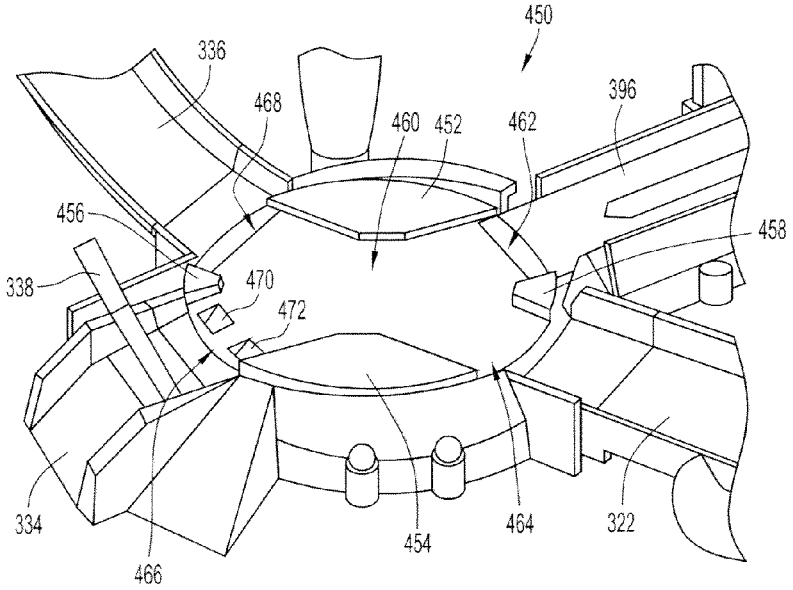
FIG. 9 illustrates a close-up perspective view of a portion of an alternative embodiment of the toy vehicle playset illustrated in FIG. 8.

Referring to FIG. 9, an alternative embodiment of a platform that can be used with playset 300 is illustrated. In particular, platform 450 has a different upper surface than and can be used instead of platform 400. In this embodiment, platform 450 has guides or raised members 452, 454, 456, and 458 that define pathways 462, 464, 466, and 468 therebetween. The pathways 462, 464, 466, and 468 are aligned with different track portions of the playset 300. For example, pathway 468 is aligned with track portion 336 which leads to the loop, pathway 462 is aligned with track portion 396 which is the exit from the device 360, pathway 464 is aligned with track portion 322 of launcher 320, and pathway 466 is aligned with exit track portion 334. This arrangement of pathways permits a toy vehicle 200 propelled by launcher 320 to travel across the platform 450 to the loop 350.

The upper surface 460 of platform 450 has a pair of notches 470 and 472 formed therein. The notches 470 and 472 are configured to receive the front wheels of a toy vehicle 200 that exits the device 360 via track 396. The notches 470 and 472 stop the movement of the toy vehicle 200 relative to the platform 450 and accordingly, assist with holding the toy vehicle 200 in place on the platform 450 while it is decorated.

Figure 10:
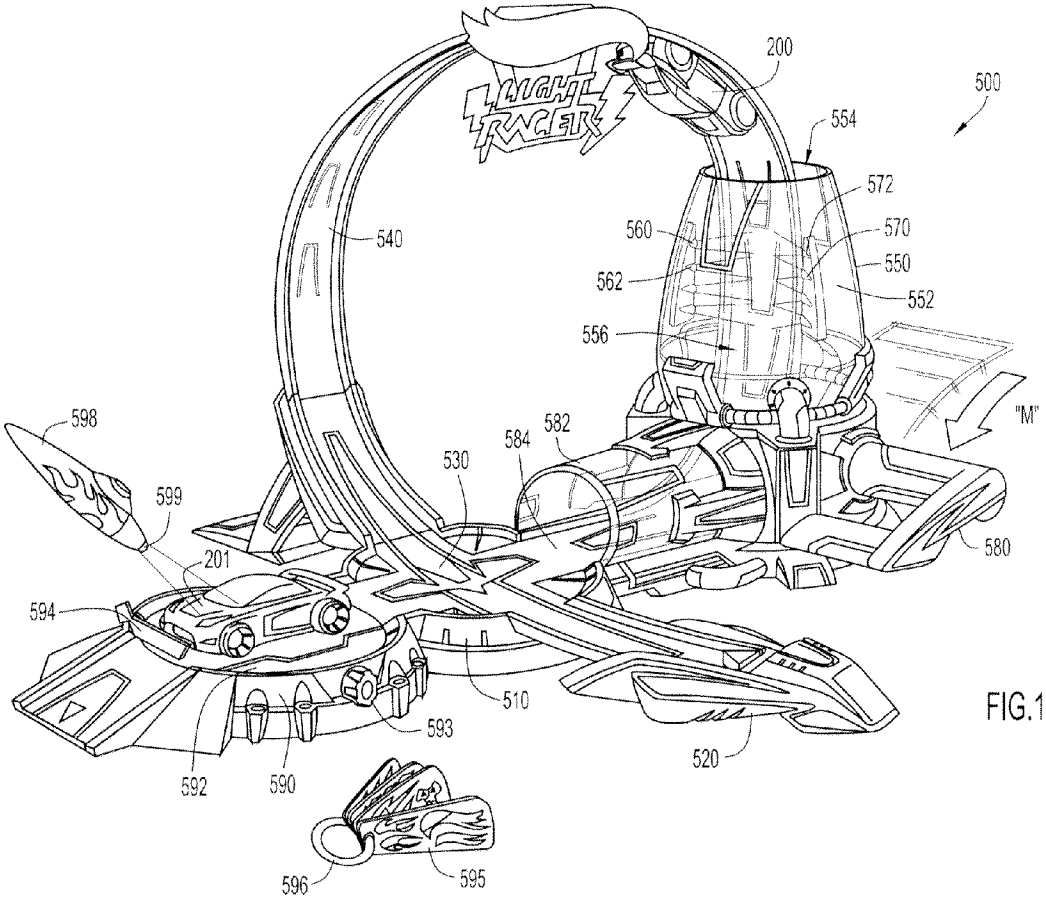
FIG. 10 illustrates a perspective view of an illuminating instrument shown with the toy vehicle playset illustrated in FIG. 8.

Referring to FIG. 10, an alternative embodiment of a toy vehicle playset according to the present invention is illustrated. Playset 500 has several components and features that are similar to playset 300. Accordingly, the features of playset 500 that are different than playset 300 are described.

Playset 500 includes a base 510, a launcher 520, an intersection portion 530, a track loop 540, and a color changing device or light chamber 550. A toy vehicle 200 can be launched by launcher 520 across the intersection portion 530, around loop 540, and into the device 550. The color changing device 550 includes a housing that is formed by housing portions coupled together. One of the housing portions is a transparent cover 552 that permits a child to see into the chamber 554 defined by the housing and view a toy vehicle 200 that is located on track portion 556.

In this embodiment, the color changing device 550 includes a light assembly that has several light sources that are fixed relative to the chamber 554. A support 560 is positioned on one side of the chamber 554. The support 560 has several UV LEDs 562 coupled thereto. The support 560 holds the LEDs 562 in a direction oriented at the track portion 556. Another support 570 is positioned on the other side of the track portion 556. Support 570 also holds several UV LEDs 572. When the electrical system is activated by a child, the UV LEDs 562 are illuminated for a brief period of time, such as twenty seconds.

After the UV LEDs 562 and 572 are no longer illuminated, the toy vehicle 200 in the chamber 554 can be released from the device 550 through tube 582 along track 584. The toy vehicle 200 is released when a child rotates handle 580 along the direction of arrow "M," which move the internal stop or gate which retained the toy vehicle 200 in the chamber 554.

In playset 500, the platform 592 on which the changed toy vehicle 201 can be decorated is located beyond the intersection portion 530. The platform 592 is rotatably mounted on a support 590. The orientation of the platform 592 can be adjusted via an actuator 593, which can be a knob. The advancement of the toy vehicle 201 is limited by the stop or gate 594.

The toy vehicle 201 can be decorated using a light instrument 598 with a light source 599. Different patterns can be applied to the toy vehicle 201 using one of several stencils 595 that can be coupled together on a ring 596.

Figure 11:
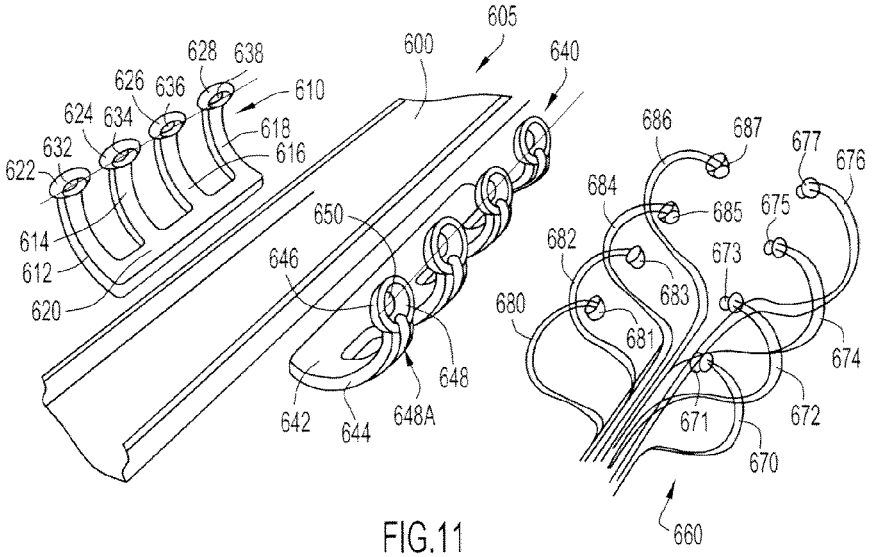
FIG. 11 illustrates a perspective view of another embodiment of a toy vehicle playset according to the present invention.
Figure 12:
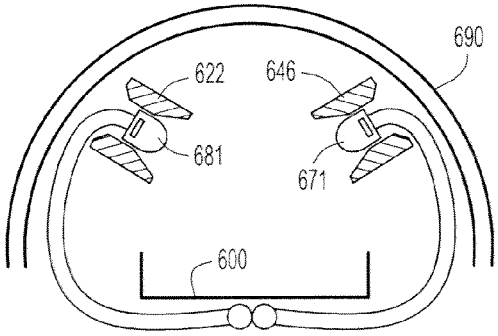
FIG. 12 illustrates an exploded perspective view of some of the components of an illumination device according to the present invention.

Referring to FIGS. 11 and 12, an embodiment of a light assembly is illustrated. The light assembly 605 is exemplary of a light assembly that can be used in the chamber 554 of color changing device 550. As shown, the light assembly 605 is located proximate to track 600 (which corresponds to track portion 556 of device 550) so that UV light from the assembly 605 is shown directly onto a toy vehicle 201 on the track 600.

On opposite sides of the track 600 are supports or holders 610 and 640. The supports 610 and 640 are vacuum metalized holders that trap and hold LEDs and wires in location in the chamber beneath the clear chamber. Support 610 includes a base 620 and several support arms 612, 614, 616, and 618 that extend upwardly from the base 620. At the upper end of the arms 612, 614, 616, and 618 are mounting portions 622, 624, 626, and 628 with respective openings 632, 634, 636, and 638 in which UV LEDs are mounted. Support 640 has a similar structure to support 610. In FIG. 11, only one of the arms of the support 640 is described for simplicity. Arm 644 extends upwardly from the base 642 and its mounting portion 646 has a tapered inner surface 648 leading to its opening 650. Also, the arm 644 has a groove 648A in which wire 670 is located. In one embodiment, the other mounting portions of the supports 610 and 640 have similarly tapered surfaces. In other embodiments, the mounting portions of the supports 610 and 640 may have straight and not tapered surfaces.

Also illustrated in FIG. 11 is a light set 660 that has several UV LEDs 671, 673, 675, 677, 681, 683, 685, and 687 and their corresponding wiring 670, 672, 674, 676, 680, 682, 684, and 686. Each of the LEDs is inserted into the opening in a corresponding one of the mounting portions of the arms of either support 610 or 640.

Referring to FIG. 12, a cross-sectional view of some of the components of a light assembly is illustrated. Within the chamber defined by the transparent cover 690, LEDs 681 and 671 are inserted into mounting portions 622 and 646, respectively. The LEDs 681 and 671 are oriented so that they are directed toward the track 600.

Figure 13:
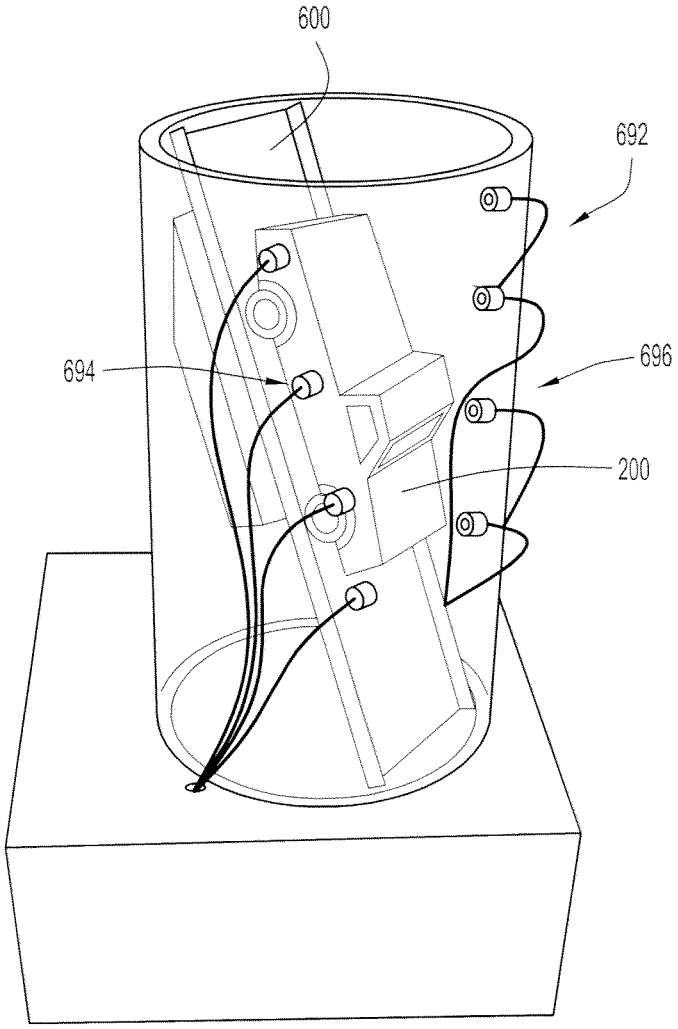
FIG. 13 illustrates a cross-sectional view of the components illustrated in FIG. 12.

Referring to FIG. 13, a container simulating a transparent housing portion 692 is illustrated with a toy vehicle 200 positioned along track 600 in a chamber defined by the portion 692. The two sets 694 and 696 of UV LEDs are shown on opposite sides of the toy vehicle 200.

Figure 14:
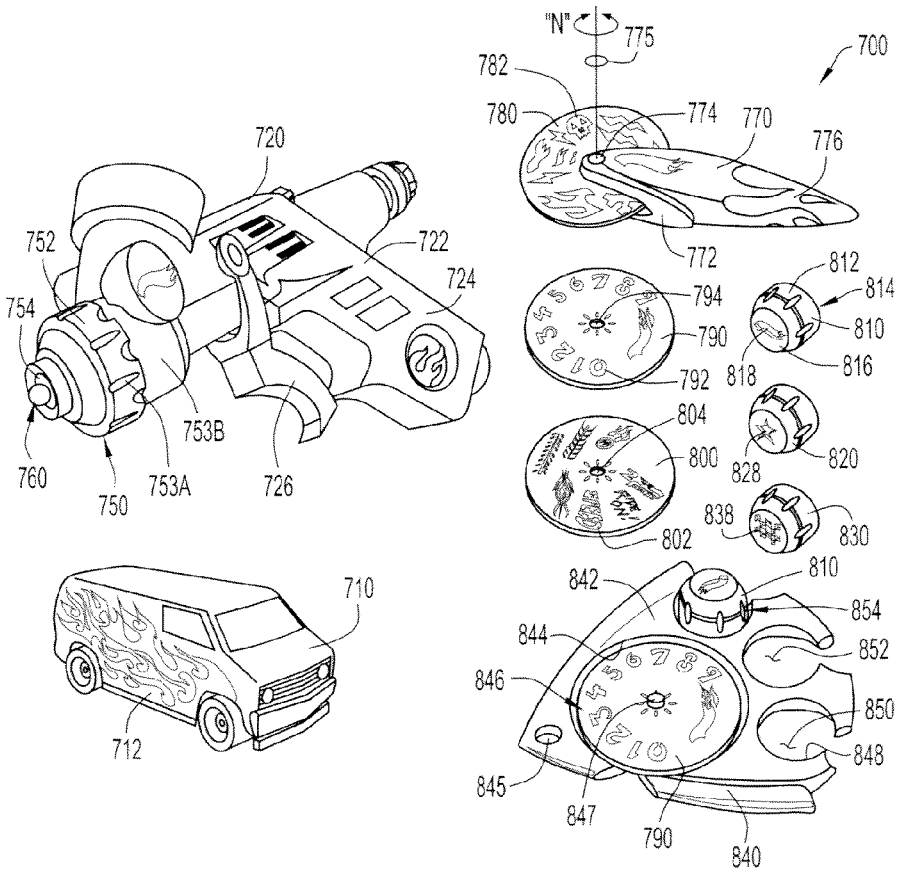
FIG. 14 illustrates a front view of an exemplary embodiment of an illumination device according to the present invention.

Referring to FIG. 14, an assembly or system for use in decorating a toy vehicle is illustrated. In this assembly, there are several different components which can be used individually or in cooperation with other components by a child to decorate a toy vehicle. The assembly 700 includes a toy vehicle 710 with a portion 712 that changes color in response to the application of UV light. As mentioned above, the color change portion 712 can be part of the molded body of the toy vehicle 710 or a coating of paint applied to the toy vehicle 710.

Figure 15:
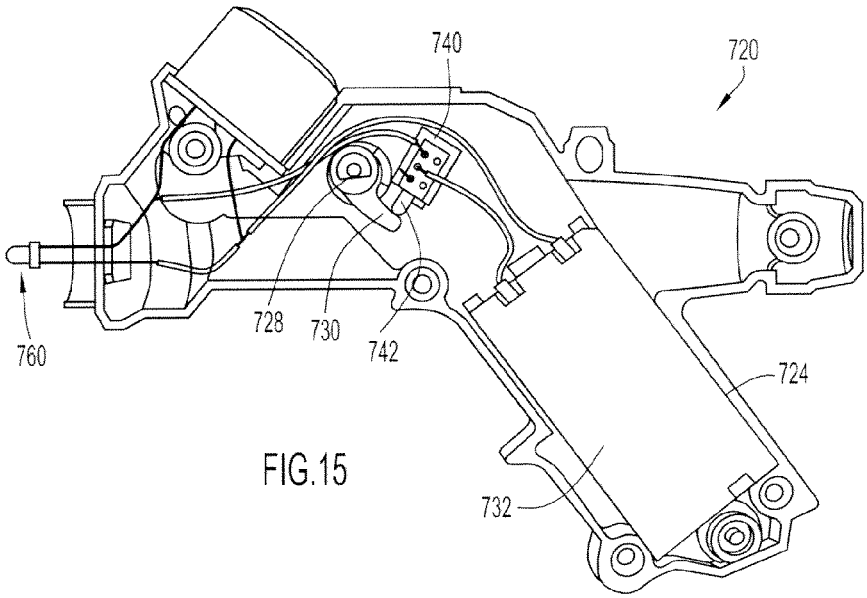
FIG. 15 illustrates several components for use with a toy vehicle according to the present invention.

A light applicator or instrument 720 can be used to direct UV light onto the toy vehicle 710. Referring to FIGS. 14 and 15, the instrument 720 includes a housing 722 with a hand grip portion 724 and a barrel portion with a distal end. A power source 732, such as a battery, is located in the hand grip portion 724. The instrument 720 has an actuatable trigger 726 that is connected to a rotatably mounted actuator 728 that has a projection 730.

The instrument 720 has a light source 760, such as a UV LED, located proximate to its distal end. The light source 760 is illuminated when a child pulls the trigger 726, which rotates actuator 728 and causes projection 730 to depress button 742 of switch 740. When the button 742 is pressed, the switch 740 is closed and the LED 760 is illuminated.

The instrument 720 includes a nozzle 750 at its distal end. The nozzle 750 has an outer surface 752 with grooves 753A and an end 753B. The nozzle 750 also has a centrally located through hole or opening 754 through which light from the LED 760, which may extend part way though the opening 754, passes.

The UV light emitted by the LED 760 can be directed or focused in a variety of ways. In one exemplary usage, the UV light can be directed through a stencil. In this embodiment, a holder 770 can be used to support the stencil and facilitate the positioning of the stencil relative to a toy vehicle 710. The holder 770 has a handle portion 776 and a groove 772 formed therein. The groove 772 is sized to permit rotation of the stencil 780 that is rotatably mounted to the holder 770 via a connector 774. The connector 774 passes through holes in the holder 770 and a centrally located hole in the stencil 780. A child can rotate the stencil 780 along the direction of arrow "N" about axis 775 so that the desired opening 782 in the stencil 780 is accessible and useable. A child can hold the handle portion 776 so that the opening or openings 782 in the stencil 780 are proximate to the toy vehicle 710. Accordingly, UV light from the instrument 720, or other instrument such as instrument 410, can be directed through the stencil 780. In FIG. 14, other exemplary stencils 790 and 800 with openings 792 and 802 and central mounting holes 794 and 804 are illustrated.

Alternatively, the UV light from instrument 720 can be controlled using a cap that is attached to the nozzle 750 of the instrument 720. The cap has a certain quantity and pattern of one or more openings that allow the light to pass therethrough. Referring to FIG. 14, cap 810 has a side wall 812 and an end wall 816 that define a cavity 814. The cavity 814 is sized and configured to be snapped onto the outer surface 752 of the nozzle 750. In one embodiment, the end of the side wall 812 has one or more protrusions or projections that extend around the end 753B of the nozzle 750 to allow the cap 810 to be snapped onto the nozzle 750.

As shown, the end wall 816 of the cap 810 has an opening 818 formed therein. When the cap 810 is mounted to nozzle 750, the UV light from instrument 720 is limited to the pattern of the opening 818 in cap 810. Thus, a child can select cap 810 with opening 818, cap 820 with opening 828, cap 830 with openings 838, or another cap with one or more openings based on the desired pattern for use with instrument 720 to decorate a toy vehicle 700. The child can place the desired cap on the nozzle 750, activate the instrument 720, and put the cap in contact with a surface of the toy vehicle 700 to get a focused, clear pattern of light applied to the surface of the toy vehicle 700 through the opening in the cap.

Also illustrated in FIG. 14 is a holder 840 that can be formed of a resilient material. The holder 840 has an opening 845 that can be used to couple the holder 840 to a keychain ring or a chain. The holder 840 has a body portion 842 with an internal wall 844 that defines a receptacle 846 in which one or stencils, such as stencil 790, can be placed for storage and transport. A post 847 is centrally located in the receptacle 846. The post 847 is positioned so that the central mounting holes of the stencils can be placed over the post 847 to align the stencils in the receptacle 846. In one embodiment, the post 847 may include one or more bumps or protrusions that extend laterally outward near the distal end of the post 847. The bumps provide resistance so that the stencils do not easily slide off of the holder 840.

The holder 840 also has several openings 850, 852, and 854 in which the caps 810, 820, and 830 can be inserted and retained via friction. As shown in FIG. 14, a side wall 848 defines opening 850 and is substantially circular. In different embodiments, any number of openings 850, 852, and 854 can be provided in the holder 840.

Figure 17:
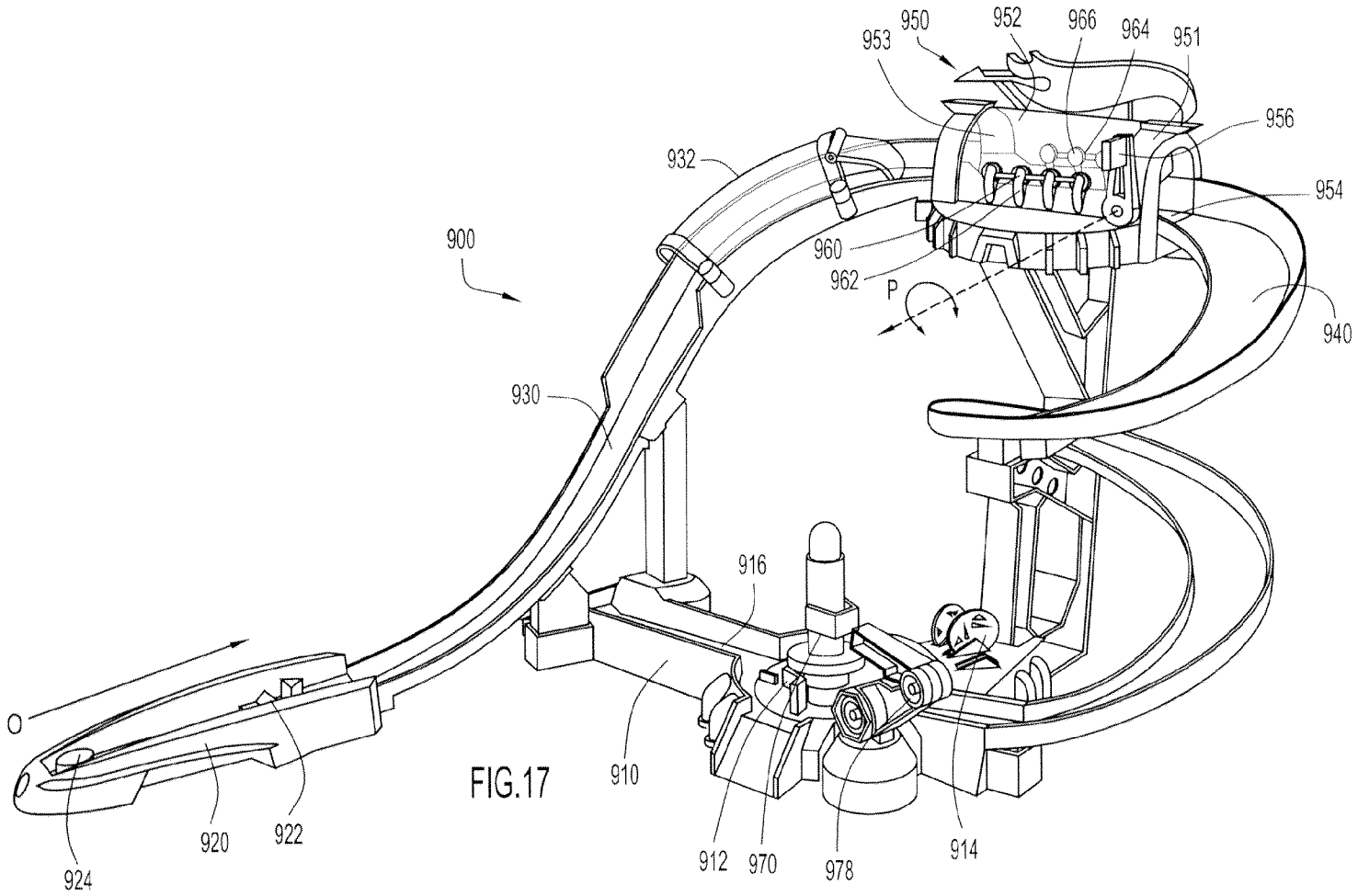
FIG. 17 illustrates a perspective view of another embodiment of a toy vehicle playset according to the present invention.

Referring to FIG. 17, an alternative embodiment of a playset according to the present invention is illustrated. In this embodiment, a toy vehicle is initially placed on a launcher. The toy vehicle is launched along a portion of track into a light chamber. The toy vehicle, which has color changing properties, is immersed in UV light from one or more light sources. After the color changing portion of the toy vehicle has changed color, the child can release the car from the light chamber. The changed toy vehicle travels along a spiral track and stops on a rotatable platform and can be further decorated by a child using a light instrument.

As shown in FIG. 17, the playset 900 includes a base 910, a launcher 920, an uphill track portion 930, a spiral track portion 940, a light chamber 950, and color changing instrument 970. The base 910 is configured to be placed on a support surface. The launcher 920 is coupled to the uphill track portion 930 and an engagement member 922 that is cocked or loaded relative to the body of the launcher 920. When the engagement member 922 is loaded, a child can press on the actuator 924 to release the spring-loaded engagement member 922, which engages the toy vehicle (not shown in FIG. 17) and propels it along the direction of arrow "O" up and along the uphill track portion 930. The uphill track portion 930 is coupled to the light chamber 950 via friction or a connector. The uphill track portion 930 contains a guide member 932 that prevents the toy vehicle from flying off of the track before entering the light chamber 950.

In this embodiment, the light chamber 950 includes a light assembly that has several light sources that are fixed relative to the interior chamber 953 which is defined by a housing 951 with a transparent portion 952. A support 960 is positioned on one side of the interior chamber 953. The support 960 has several UV LEDs 962 coupled thereto. The support 960 holds the LEDs 962 in a direction oriented at the track portion 954. Another support 964 is positioned on the other side of the track portion 954. Support 964 also holds several UV LEDs 966. When the electrical system is activated by a child, the UV LEDs 962 and 966 are illuminated for a brief period of time, such as twenty seconds.

After the UV LEDs 962 and 966 are no longer illuminated, the toy vehicle in light chamber 950 can be released. The toy vehicle is released when a child rotates handle 956 along the direction of arrow "P," which moves the internal stop or gate which retained the toy vehicle in the light chamber 950.

In playset 900, a platform 912 is rotatably mounted on base 910. The platform 912 is positioned beyond the connection between the spiral track portion 940 and the base 910. Positioned adjacent to the platform 912 on base 910 is a stencil holder 914 and the color changing instrument 970. The color changing instrument 970 is attached to the base 910 via a repositionable support arm 978. The support arm 978 provides stability to the color changing instrument 970 when it is used to decorate the toy vehicle.

Figure 18:
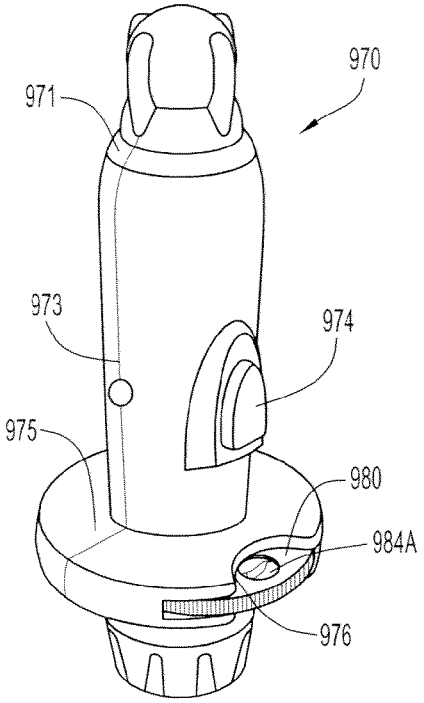
FIG. 18 illustrates a front view of an exemplary embodiment of an illumination device according to the present invention.
Figure 19:
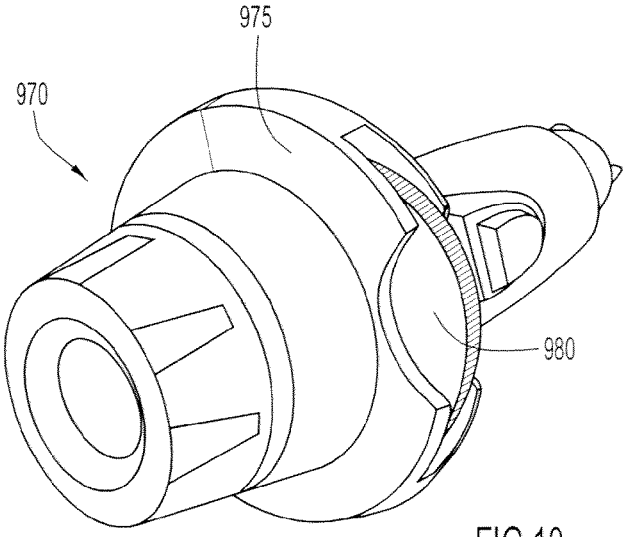
FIG. 19 illustrates a bottom perspective view of the illumination device of FIG. 18, according to the present invention.

Referring to FIGS. 18 and 19, an embodiment of the color changing instrument 970 is illustrated. The color changing instrument 970 is used to direct UV light onto a toy vehicle. The instrument 970 includes a housing 971 with a hand grip portion 973. The hand grip portion 973 has an actuator 974 disposed on it. A power source (not shown), such as a battery, is located in the hand grip portion 973. The instrument 970 has an internal light source, such as a UV LED, located proximate to its distal end. The light source is illuminated when a child pushes the actuator 974.

The instrument 970 includes a receptacle 975 that is configured to receive a stencil 980. The stencil 980 may rotate within the receptacle 975. When aligned properly within the receptacle 975, the stencil 980 directs or focuses the UV light emitted from the light source 972, allowing a child to create designs on the toy vehicle. Furthermore, the receptacle 975 contains a viewing portion 976, which is a cut away portion of the receptacle 975.

Figure 20:
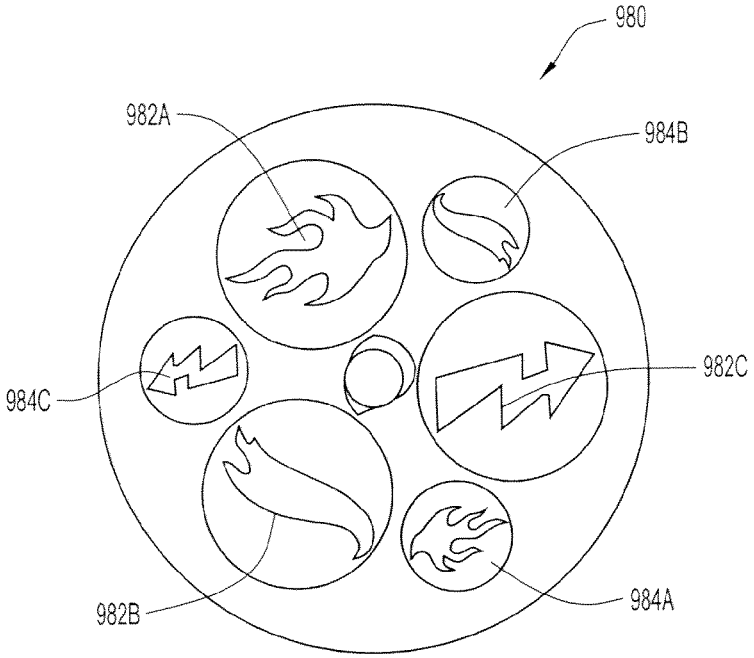
FIG. 20 illustrates a top view of an embodiment of a stencil according to the present invention.

Referring to FIG. 20, an embodiment of the stencil 980 is illustrated. In this embodiment, stencil 980 may contain up to three stencil designs 982A, 982B, and 982C. In other embodiments, the stencil 980 may contain more or less designs. The stencil 980 may also contain design indicators 984A, 984B, and 984C positioned opposite on the stencil from their corresponding stencil designs 982A, 982B, and 982C. In this embodiment, indicator 984A refers to design 982A. Furthermore, indicator 984B refers to design 982B, and indicator 984C refers to design 982C. The view portion 976 of the instrument 970 (see FIGS. 18 and 19) allows the child to view the stencil indicator 984A, 984B, or 984C that indicates which stencil design 982A, 982B, or 982C is aligned with the light source 972 within the receptacle 975.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A vehicle playset, comprising:
a track member;
a launching mechanism coupled to the track member;
a chamber coupled to the track member and including a light source within the chamber;
a toy vehicle containing color changing properties configured to be launched from the launching mechanism and travel along the track member into the chamber, wherein the chamber is configured to retain the toy vehicle therein and the toy vehicle changes color when the light source shines on the toy vehicle; and
an actuator engageable by a user to release the toy vehicle from the chamber.

2. The vehicle playset of claim 1, wherein the light source emits an ultraviolet (UV) or near UV light.

3. The vehicle playset of claim 1, wherein the light source includes a plurality of LEDs.

4. The vehicle playset of claim 1, further comprising:
at least one stencil.

5. The vehicle playset of claim 4, wherein the chamber includes a lid configured to receive the stencil, and when the stencil is coupled to the lid, the stencil is usable to control the light from the light source that contacts the toy vehicle within the chamber.

6. The vehicle playset of claim 1, further comprising:
an instrument comprising a UV or near UV light emitting source.

7. A vehicle playset comprising:
a track member;
a launching mechanism coupled to the track member;
a chamber coupled to the track member and including a UV or near UV light emitting source within the chamber;
a toy vehicle containing color changing properties configured to be launched from the launching mechanism and travel along the track member into the chamber, wherein the chamber is configured to retain the toy vehicle therein and the toy vehicle changes color when the light from the light emitting source engages the toy vehicle, and
an actuator engageable by a user to release the toy vehicle from the chamber.

8. The vehicle playset of claim 7, wherein the light source includes a plurality of LEDs.

9. The vehicle playset of claim 8, wherein at least one LED is located on a first side of the toy vehicle and at least one LED is located on a second side of the toy vehicle.

10. The vehicle playset of claim 9, wherein the chamber includes a track portion therein and the vehicle playset further comprises:
a first support on a first side of the track portion, the first support holding at least one LED; and
a second support on a second side of the track portion, the second support holding at least one LED.

11. The vehicle playset of claim 7, further comprising:
a switch connected to the light emitting source, the switch being closed by the toy vehicle when the toy vehicle is in the chamber, and the light emitting source is illuminated once the switch is closed.

12. The vehicle playset of claim 11, wherein the chamber includes a stop, the switch is closed by the toy vehicle when the toy vehicle engages the stop, and the stop is movable by the actuator to release the toy vehicle.

13. The vehicle playset of claim 12, wherein the actuator is a pivotally mounted handle, and the toy vehicle is released onto another track member.

14. A vehicle playset, comprising:

a base comprising:

a launching mechanism;

a chamber including a light source;

a platform rotatably coupled to the base; and an actuator disposed on the base;

a track member coupled to the launching mechanism and the chamber; and a toy vehicle containing color changing properties and configured to be launched from the launching mechanism and travel along the track member into the chamber, wherein the chamber is configured to retain the toy vehicle and engagement of the actuator by a user releases the toy vehicle from the chamber, and the toy vehicle changes color when the light source shines on the toy vehicle.

15. The vehicle playset of claim 14, further comprising:

a rotatable actuator in communication with the platform, wherein when the actuator is rotated, the platform is rotated.

16. The vehicle playset of claim 14, wherein the light source emits UV or near UV light.

17. The vehicle playset of claim 14, further comprising:

an instrument comprising a UV light emitting source.

18. The vehicle playset of claim 14, wherein the light source includes a plurality of LEDs.

19. The vehicle playset of claim 14, wherein the launching mechanism includes a button and a spring configured to launch the toy vehicle when the button is moved, and the toy vehicle exits the chamber and travels to the platform.

* * * * *